US007305859B2

(12) United States Patent
Ootsuka et al.

(10) Patent No.: US 7,305,859 B2
(45) Date of Patent: Dec. 11, 2007

(54) ROLLING MILL

(75) Inventors: Hiroyuki Ootsuka, Yokohama (JP); Hisashi Honjou, Yokohama (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 0 days.

(21) Appl. No.: 11/565,982

(22) Filed: Dec. 1, 2006

(65) Prior Publication Data

US 2007/0125144 A1 Jun. 7, 2007

(30) Foreign Application Priority Data

Dec. 2, 2005 (JP) ..... P2005-348980

(51) Int. Cl.
*B21B 37/28* (2006.01)

(52) U.S. Cl. ..... 72/9.1; 72/11.7; 72/236; 72/43

(58) Field of Classification Search ..... 72/200, 72/201, 236, 250, 9.1, 11.7, 224, 225, 242.2, 72/41, 43, 342.2, 342.3, 342.7
See application file for complete search history.

(56) References Cited

U.S. PATENT DOCUMENTS 4,467,629 A * 8/1984 Schimion ..... 72/11.7
4,793,172 A * 12/1988 Eibe ..... 72/200
4,974,437 A * 12/1990 Schiller ..... 72/236
5,799,523 A * 9/1998 Seidel et al. ..... 72/9.3
6,014,881 A * 1/2000 Imanari ..... 72/201
6,490,903 B2 * 12/2002 Ravenet et al. ..... 72/236
6,697,699 B2 * 2/2004 Gramckow et al. ..... 700/154
7,159,433 B2 * 1/2007 Seidel ..... 72/201
7,181,822 B2 * 2/2007 Ondrovic et al. ..... 29/527.7

OTHER PUBLICATIONS

Shibakyo News (No. 43), pp. 6-22, 1966.

* cited by examiner

*Primary Examiner*—Dmitry Suhol
(74) *Attorney, Agent, or Firm*—Ostrolenk, Faber, Gerb & Soffen, LLP

(57) ABSTRACT

The rolling mill comprises a pair of work rolls for rolling a plate material in the thickness direction, a guide for guiding the leading end of the plate material between the work rolls, and a rolling oil supply member for supplying rolling oil between the work rolls through a rolling oil passage formed within the guide. The rolling mill further comprises a temperature adjusted oil passage formed within the guide separately from the rolling oil passage, and a temperature adjusted oil supply member for applying temperature adjusted oil having a different temperature from the rolling oil to the work rolls through the temperature adjusted oil passage so as to control the crown rate of the work rolls, improving the controllability of the crown rate of the work roll.

7 Claims, 4 Drawing Sheets

ROLLING MILL

BACKGROUND OF THE INVENTION

1. Field of the Invention

The present invention relates to a rolling mill in which rolling oil is supplied between work rolls for rolling a plate material in the thickness direction through the inside of the guide.

The present application claims priority of Japanese Patent Application No. 2005-348980 filed Dec. 2, 2005, the contents of which is incorporated herein.

2. Description of the Related Art

In a rolling mill in which a plate material is rolled by a pair of work rolls, for example, to form a sheet, rolling oil called coolant is supplied for cooling and lubricating the work rolls.

Some rolling mills are provided with multiple intermediate rolls in contact with the work rolls and the rotation of the intermediate rolls is transferred to the work rolls for rolling (see "Structure of 300 mm reverse rotation ten-step cold rolling mill (commonly called X mill) and rolling test results," Shibakyo News (No. 43), pp. 6-22, 1966). In such rolling mills, sufficient space for supplying the coolant between the work rolls may not be assured because multiple intermediate rolls having a larger diameter than the work mills are provided in contact with the work rolls.

When sufficient space for supplying the rolling oil between the work rolls is not assured, a coolant passage is formed within the guide provided for guiding the leading end of the plate material between the work rolls, through which passage coolant is supplied between the work rolls (for example, see the page 15 of the above reference).

On the other hand, apart from the coolant supplied between the work rolls, temperature adjusted coolant is applied to the work rolls to control the crown rate of the work rolls in some rolling mills.

However, even a sufficient space for supplying the coolant for cooling and lubricating the work rolls is not assured in rolling mills in which a passage within the guide is used to supply coolant to the work rolls, making it difficult to provide a header for applying coolant to the work rolls for controlling the crown rate.

Alternatively, the temperature and flow rate of the coolant for cooling and lubricating the work rolls can be adjusted to control the crown rate. However, the temperature and flow rate of the coolant for cooling and lubricating the work rolls should be adjusted within significantly limited ranges. Therefore, the crown rate of the work rolls cannot be changed over a sufficient range.

The present invention is proposed in view of the above problems and the purpose of the present invention is to improve the controllability of the crown rate of the work rolls in a rolling mill in which coolant is supplied to the work rolls through a passage formed within the guide.

SUMMARY OF THE INVENTION

In order to achieve the above purpose, the present invention provides a rolling mill comprising a pair of work rolls for rolling plate material in the thickness direction, a guide for guiding the leading end of the plate material between the work rolls, and a rolling oil supply member for supplying rolling oil between the work rolls through a rolling oil passage formed within the guide. Furthermore, the rolling mill is characterized by comprising a temperature adjusted oil passage formed within the guide separately from the rolling oil passage, and a temperature adjusted oil supply member for applying temperature adjusted oil having a different temperature from the rolling oil to the work rolls through the temperature adjusted oil passage to control the crown rate of the work rolls.

The rolling mill of the present invention may have a structure in which the temperature adjusted oil supply member comprises a profile data acquisition member for acquiring data indicating the profile of the plate material rolled by the work rolls and a control member for controlling the temperature and/or flow rate of the temperature adjusted oil based on the data indicating the profile of the plate material.

The rolling mill of the present invention may further have a structure in which the temperature adjusted oil passage is divided into multiple passages in the crosswise direction of the work rolls and the temperatures and/or flow rates of the temperature adjusted oil applied to the work rolls through the divided passages can be controlled independently.

The rolling mill of the present invention may further have a structure in which a heat insulator is provided between the rolling oil passage and the temperature adjusted oil passage.

The rolling mill of the present invention may further have a structure in which when the guide is provided both above and below the plate material, the temperature adjusted oil passage is formed only within the guide below the plate material.

The rolling mill of the present invention may further have a structure in which the rolling oil passage is provided in the upper part and the temperature adjusted oil passage is provided in the lower part within the guide where the temperature adjusted oil passage is provided among the above guides.

The rolling mill of the present invention may further have a structure in which rolls are provided in contact with the work rolls.

According to the rolling mill of the present invention having the above characteristics, the rolling oil passage and temperature adjusted oil passage are formed within the guide, rolling oil is supplied to the work rolls through the rolling oil passage, and temperature adjusted oil is applied to the work rolls through the temperature adjusted oil passage.

In this way, the rolling mill of the present invention does not need to have an additional header for applying temperature adjusted oil to the work rolls and the temperature and flow rate of the temperature adjusted oil can be adjusted without changing the temperature and flow rate of the rolling oil. In other words, the temperatures and flow rates of the rolling oil and temperature adjusted oil can be controlled independently. Therefore, the crown rate of the work rolls can be changed over a sufficient range without changing the temperature and flow rate of the rolling oil.

Consequently, the rolling mill of the present invention improves the controllability of the crown rate of the work rolls.

DETAILED DESCRIPTION OF THE PREFERRED EMBODIMENTS

Figure 1:
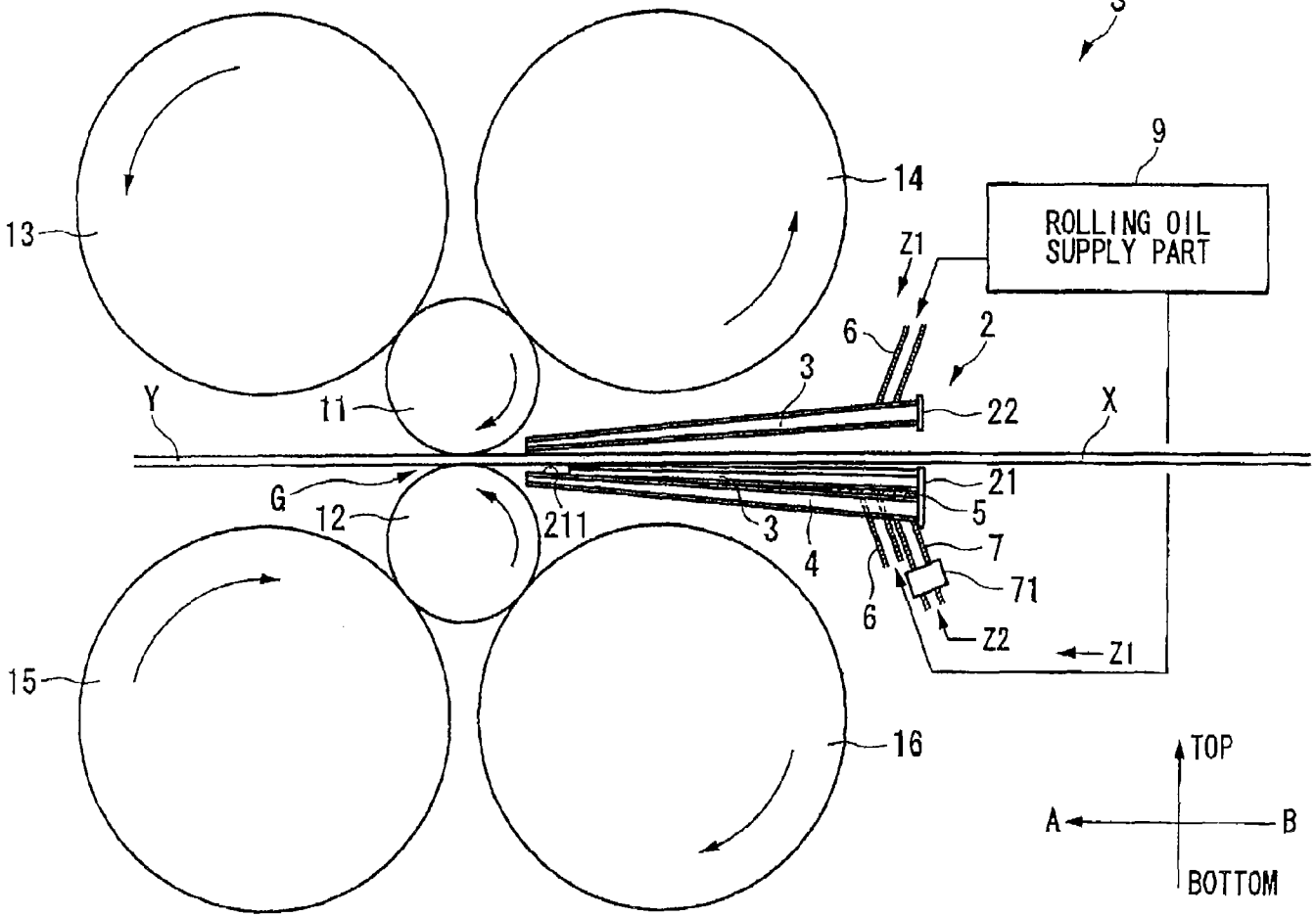
FIG. 1 is a schematic illustration showing the structure of an embodiment of the rolling mill of the present invention.
Figure 2:
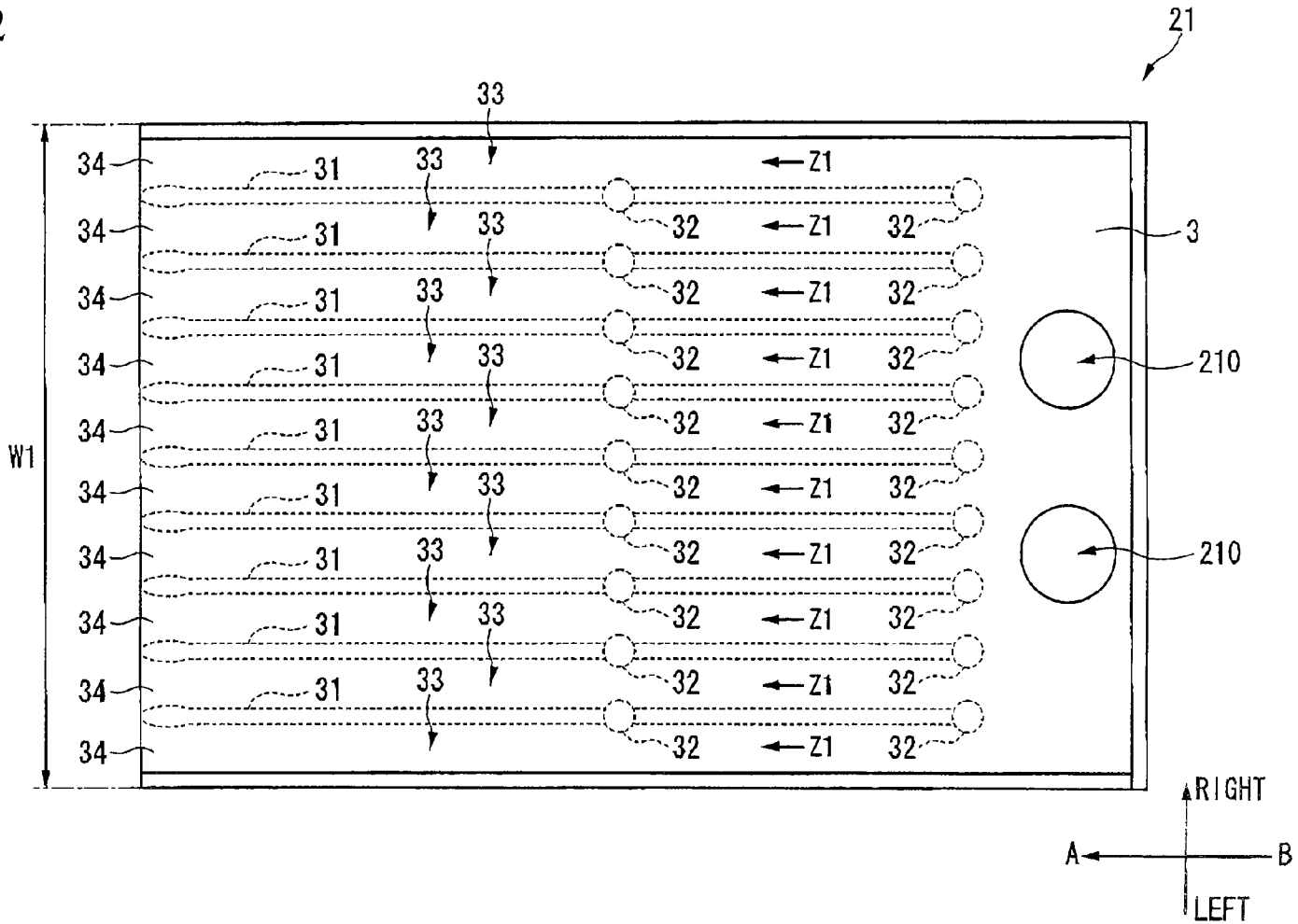
FIG. 2 is a plane view of the upper part of the bottom guide.
Figure 3:
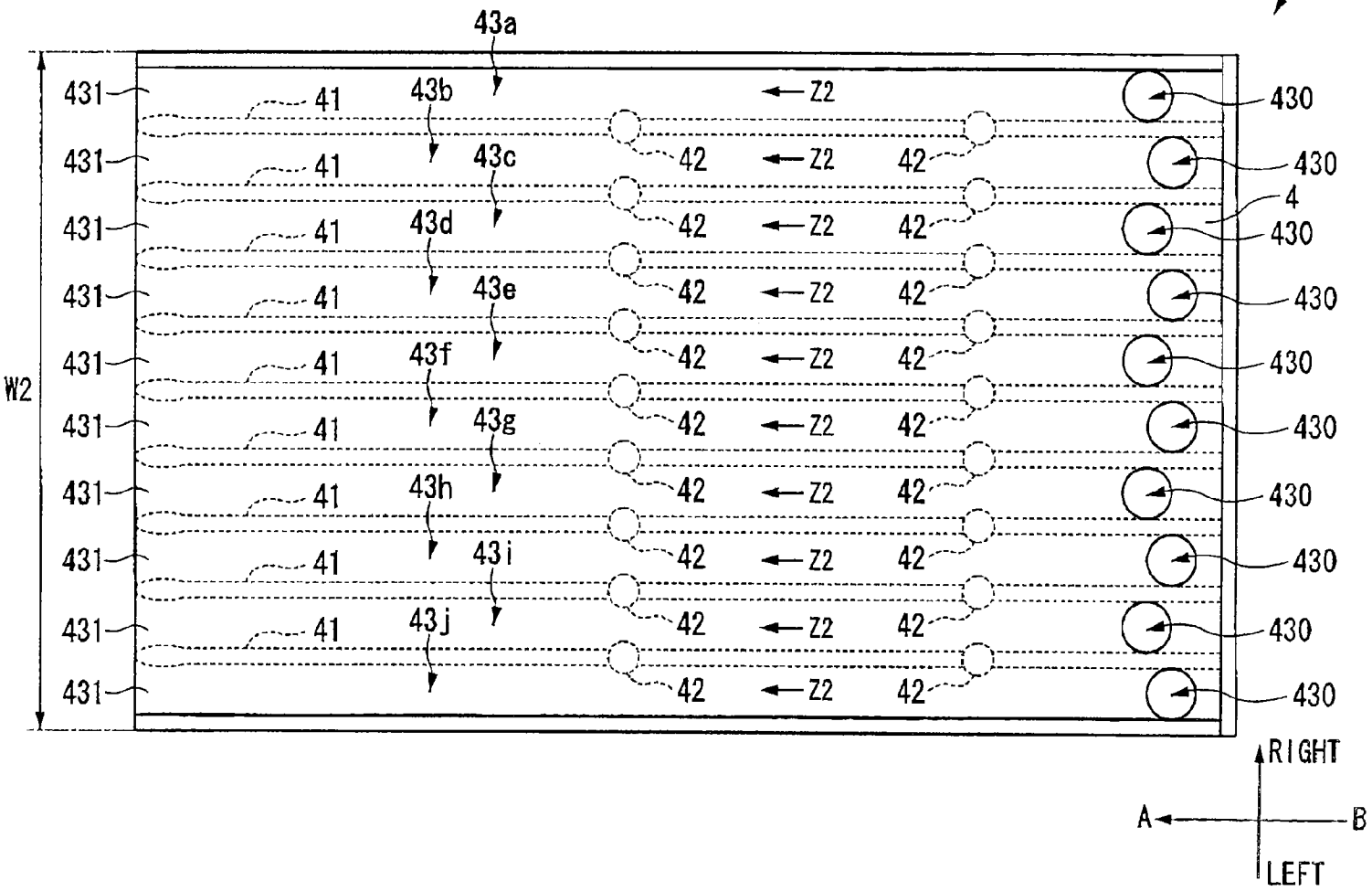
FIG. 3 is a plane view of the lower part of the bottom guide.

An embodiment of the rolling mill of the present invention is described hereafter with reference to the drawings. In the figures, the components are shown in different scales as appropriate for recognition. In FIG. 1, the direction A is to the left; the direction B, to the right; the upward direction, to the top; and the downward direction, to the bottom. In FIGS. 2 and 3, the upward direction is to the right and the downward direction is to the left.

FIG. 1 is a schematic illustration showing the structure of a rolling mill S of this embodiment. As shown in the figure, the rolling mill S of this embodiment comprises a pair of work mills 11 and 12, back up rolls 13, 14, 15, and 16, and a guide 2.

The work rolls 11 and 12 roll plate material X which is sent from the side B in the thickness direction and discharge as a sheet Y to the side A.

Specifically, as shown in FIG. 1, among the work rolls 11 and 12 provided one above the other, the top work roll 11 is rotated in the direction of the arrow (right rotation in the figure) and the bottom work roll 12 is rotated in the direction of the arrow (left rotation in the figure), whereby the plate material X is rolled between the work rolls 11 and 12 (termed the inter-work roll space G hereafter) in the thickness direction.

The back up rolls 13, 14, 15, and 16 are provided in contact with the work rolls 11 and 12.

Specifically, the back up rolls 13 and 14 are in contact with the work roll 11 and the back up rolls 15 and 16 are in contact with the work roll 12.

As the back up rolls 13, 14, 15, and 16 are rotated by an un-shown motor, their rotations are transferred to the work rolls 11 and 12, whereby the work rolls 11 and 12 are rotated.

The guide 2 is provided to guide the leading end of the plate material X into the inter-work roll space G when the operation is started. In this embodiment, the guide 2 consists of a bottom guide 21 provided below the plate material X and a top guide 22 provided above the plate material X. Here, the guide 2 is supported by an un-shown support mechanism connected to the enclosure of the rolling mill S.

As shown in FIG. 1, a rolling oil passage 3 is formed at the top and a temperature adjusted oil passage 4 is formed at the bottom within the bottom guide 21. In other words, in this embodiment, the temperature adjusted oil passage 4 is formed separately from the rolling oil passage 3.

A heat insulator 5 is provided between the rolling oil passage 3 and the temperature adjusted oil passage 4. The rolling oil passage 3 is made shorter than the temperature adjusted oil passage 4 within the bottom guide 21 of the rolling mill S of this embodiment.

The rolling oil passage 3 is a passage intended to supply rolling oil Z1 for entirely cooling and lubricating the work rolls 11 and 12 in the inter-work roll space G.

FIG. 2 is a plane view of the upper part of the bottom guide 21. As shown in the figure, the rolling oil passage 3 is formed by placing multiple partitions 31 extended along the direction of the rolling oil Z1 in the hollow space at the upper part of the bottom guide 21. The partitions 31 are supported by the bottom guide body via support parts 32.

Two supply ports 210 are formed near the end of the bottom guide 21 for supplying the rolling oil Z1 into the bottom guide 21. The supply ports 210 are each connected to a rolling oil supply duct 6.

As shown in FIG. 2, the partitions 31 are not formed near the supply ports 210. The passages 33 divided by the partitions 31 are open and communicate with each other near the supply ports 210. Therefore, the rolling oil Z1 supplied from the supply ports 210 is able to flow into any passages 33. Openings 34 are formed at the opposite end of the bottom guide 21 to the supply ports 210. The rolling oil Z1 flows into the passages 33 from the supply ports 210 and flows out from the openings 34.

The width W1 of the bottom guide 21 is nearly equal to the width of the work rolls 11 and 12, whereby the rolling oil Z1 supplied through the rolling oil passage 3 is supplied to the entire inter-work roll space G.

In practice, the rolling oil passage 3 is made shorter than the temperature adjusted oil passage 4. As shown in FIG. 1, the bottom guide 21 is shorter in the upper part than in the lower part, and therefore, the rolling oil Z1 discharged from the rolling oil passage 3 is supplied into the inter-work roll space G along the top surface 211 of the lower part of the bottom guide 21. As shown in FIG. 1, the bottom guide 21 is slanted so that it is closer to the plate material X near the inter-work roll space G. Then, with the bottom guide 21 being shorter in the upper part than in the lower part, the bottom guide 21 can have a reduced total height, preventing the plate material X from interfering with the bottom guide 21.

The temperature adjusted oil passage 4 is a passage intended to apply temperature adjusted oil to the work roll 12 for controlling the crown rate of the work rolls 11 and 12.

FIG. 3 is a plane view showing the lower part of the bottom guide 21. As shown in the figure, the temperature adjusted oil passage 4 is formed by placing multiple partitions 41 extended along the direction of the temperature adjusted oil Z2 in the hollow space at the lower part of the bottom guide 21. The partitions 41 are supported by the bottom guide body via support 42.

The partitions 41 of the temperature adjusted oil passage 4 are extended from one end to the other of the bottom guide 21, and separating passages 43*a* to 43*j*. A supply port 430 corresponds to each of the passages 43*a* to 43*j* is provided at one end of the passages 43*a* to 43*j*. Temperature adjusted oil supply ducts 7 are connected to the supply ports 430 as shown in FIG. 1. Furthermore, a discharge port 431 corresponds to each of the passages 43*a* to 43*j* is provided at the other end of the passages 43*a* to 43*j*. The temperature adjusted oil Z2 flows into the passages 43*a* to 43*j* from the supply ports 430 and flows out from the discharge ports 431.

As described above, the width W2 of the bottom guide 21 is nearly equal to the width of the work rolls 11 and 12. Therefore, the temperature adjusted oil Z2 can be applied to the entire work roll 12.

The temperature adjusted oil passage 4 is divided into 10 fine passages 43*a* to 43*j* by partitions 41. These passages 43*a* to 43*j* are arranged in the crosswise direction of the work roll 12. Therefore, by adjusting the temperature and flow rate of the temperature adjusted oil Z2 flowing through the passages 43*a* to 43*j*, the temperature adjusted oil Z2 can be applied to the work roll 12 locally at different temperatures and flow rates. In the rolling mill S of the present invention, a valve 71 and a heater 72 are provided with each of the temperature adjusted oil supply ducts 7 so that the temperature adjusted oil Z2 can be applied to the work roll 12 locally at different temperatures and flow rates (see FIG. 4).

Referring to FIG. 1, only a rolling oil passage 3 is formed within the top guide 22. The rolling oil passage 3 formed within the top guide 22 has the same structure as the temperature adjusted oil passage 4 formed within the bottom guide 21, except that it has the same length as the temperature adjusted oil passage 4 formed within the bottom guide 21.

The rolling oil Z1 having a fixed temperature and flow rate is supplied to the rolling oil ducts 6 connected to the rolling oil passage 3 formed within the bottom guide 21 and the rolling oil ducts 6 connected to the rolling oil passage 3 formed within the top guide 22 via a rolling oil supply part 9 (rolling oil supply member).

Figure 4:
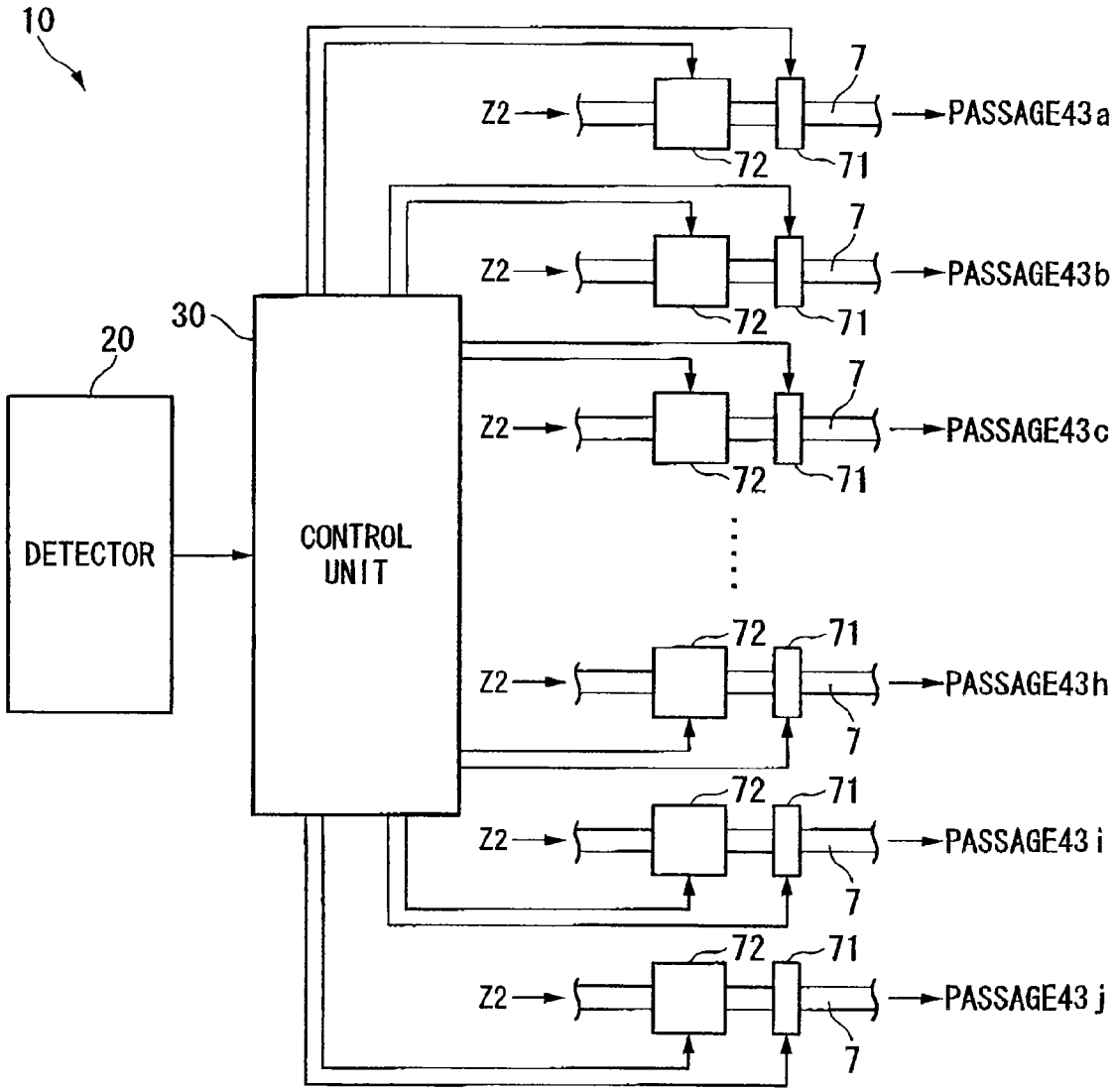
FIG. 4 is a block diagram showing the functions of the control system of an embodiment of the rolling mill of the present invention.

FIG. 4 is a block diagram showing the structure and functions of a control system 10 (temperature adjusted oil supply member) for controlling the temperature and flow rate of the temperature adjusted oil Z2.

The control system 10 comprises a detector 20 (profile data acquisition member) and a control unit 30 (control member) as shown in FIG. 4. The temperature adjusted oil Z2 having a different temperature from the rolling oil Z1 is applied to the work roll 12 through the temperature adjusted oil passage 4 to control the crown rate of the work roll 12 (the difference in diameter between the center and end of the roll).

The detector 20 acquires data indicating the profile of the plate material X rolled by the work rolls 11 and 12 and is provided at a point where the sheet Y is discharged. The detector 20 may be, for example, a laser interferometer or a camera.

The control unit 30 controls the temperature and/or flow rate of the temperature adjusted oil Z2 based on the detection results (data indicating the profile of the sheet Y) of the detector 20.

Specifically, the control unit 30 controls the valves 71 and heaters 72 provided to each of the temperature adjusted oil ducts 7 based on the detection results of the detector 20. Each of the temperature adjusted oil ducts 7 is connected to the corresponding passage 34*a* to 43*j* of the temperature adjusted oil passages 4. Therefore, the temperatures and flow rates of the temperature adjusted oil Z2 through the passages 43*a* to 43*j* can be independently controlled in the rolling mill S of the present invention.

The coolant used in the prior art rolling mill may be used for the rolling oil Z1 and temperature adjusted oil Z2 although they have different purposes.

The operation of the rolling mill S of this embodiment having the above structure is described hereafter.

First, the leading end of the plate material X is guided into the inter-work roll space G by the guide 2. The plate material X is rolled by the work rolls 11 and 12 and the sheet Y is discharged on the side A in FIG. 1. The rolling oil Z1 having a fixed temperature and flow rate is continuously supplied into the inter-work roll space G by the rolling oil supply part 9 through the rolling oil passage 3 while the plate material X is rolled by the work rolls 11 and 12.

Then, the detector 20 acquires data indicating the profile of the sheet Y in the rolling mill S of the present invention. Subsequently, the control unit 30 calculates the profile of the sheet Y based on the data indicating the profile of the sheet Y acquired by the detector 20.

As a result of the calculation, when the sheet Y is swelled in the center in the crosswise direction, the control unit 30 opens, for example, the valves 71 of the temperature adjusted oil ducts 7 connected to the passages 43*e* and 43*f* of the temperature adjusted oil passage 4 and adjusts the temperature and flow rate of the temperature adjusted oil Z2 through the passages 43*e* and 43*f* using the heaters 72 of the temperature adjusted oil ducts 7 connected to the passages 43*e* and 43*f*.

In this way, the heated temperature adjusted oil Z2 is applied to the work roll 12 through the passages 43*e* and 43*f*, whereby the temperature adjusted oil Z2 is applied to the work roll 12 only in the central part to increase the crown rate. Consequently, the sheet Y can be flattened.

On the other hand, when the sheet Y is sunk in the center in the crosswise direction, the control unit 30 opens, for example, the valves 71 of the temperature adjusted oil ducts 7 connected to the passages 43*a* and 43*j* of the temperature adjusted oil passage 4 and adjusts the temperature and flow rate of the temperature adjusted oil Z2 through the passages 43*a* and 43*j* using the heaters 72 of the temperature adjusted oil ducts 7 connected to the passages 43*a* and 43*j*.

In this way, the heated temperature adjusted oil Z2 is applied to the work roll 12 through the passages 43*a* and 43*j*, whereby the temperature adjusted oil Z2 is applied to the work roll 12 only near the ends to reduce the crown rate. Consequently, the sheet Y can be flattened.

With the rolling mill S of the above described embodiment, the rolling oil passage 3 and temperature adjusted oil passage 4 are formed within the guide 2, the rolling oil Z1 is supplied into the inter-work roll space G through the rolling oil passage 3, and the temperature adjusted oil Z2 is applied to the work roll 12 through the temperature adjusted oil passage 4.

In this way, an additional header for applying the temperature adjusted oil Z2 to the work roll 12 is unnecessary and the temperature and flow rate of the temperature adjusted oil Z2 can be adjusted without changing the temperature and flow rate of the rolling oil Z1. In other words, the temperatures and flow rates of the rolling oil Z1 and temperature adjusted oil Z2 can be independently controlled. Consequently, the crown rate of the work roll 12 can be changed over a sufficiently large range without changing the temperature and flow rate of the rolling oil Z1.

Hence, the rolling mill S of this embodiment can improve the controllability of the crown rate of the work roll 12.

In the rolling mill S of this embodiment, data indicating the profile of the sheet Y comprising the rolled plate material X, are acquired and the temperature and/or flow rate of the temperature adjusted oil Z2 is controlled based on the data indicating the profile of the sheet Y. In other words, the crown rate of the work roll 12 is controlled using the feedback of an actual sheet profile, enabling more accurate control of the crown rate of the work roll 12 to be achieved.

In the rolling mill S of this embodiment, the temperature adjusted oil passage 4 is divided into ten fine passages 43*a* to 43*j* by the partitions 41 and the passages 43*a* to 43*j* are arranged in the crosswise direction of the work roll 12. Furthermore, the passages 43*a* to 43*j* are each connected to the temperature adjusted oil duct 7 having the valve 71 and the heater 72. In this way, the temperatures and flow rates of the temperature adjusted oil passage 4 through the passages 43*a* to 43*j* can be controlled independently, whereby the temperature adjusted oil Z2 can be applied to the work roll 12 locally at different temperature and flow rates. Consequently, finer control of the crown rate of the work roll 12 can be achieved For example, the crown rate of the work roll 2 can be controlled only by adjusting the flow rate of the temperature adjusted oil Z2 while the temperature of the temperature adjusted oil Z2 is fixed. In this case, the heaters 72 can be integrated.

In the rolling mill S of this embodiment, since the insulator 5 is provided between the rolling oil passage 3 and the temperature adjusted oil passage 4, the temperature of the rolling oil Z1 flowing through the rolling oil passage 3 can be prevented from being changed when the temperature adjusted oil Z2 having a different temperature from the rolling oil Z1 flows through the temperature adjusted oil passage 4.

In the rolling mill S of this embodiment, the temperature adjusted oil passage 4 is formed only within the bottom guide 21 and furthermore is formed in the lower part of the bottom guide 21. According to this structure, mixture of the temperature adjusted oil Z2 which is applied to and dripping down from the work roll 2 with the rolling oil Z1 can be prevented.

Consequently, for example, when the sheet Y is required to have a glossy surface, deterioration of the glossy surface of the sheet Y by mixing the temperature adjusted oil Z2 with the rolling oil Z1 can be prevented.

However, the temperature adjusted oil passage 4 can also be formed within the top guide 22 to apply the temperature adjusted oil Z2 also to the work roll 11 where no problems occur with a small amount of temperature adjusted oil Z2 mixed with the rolling oil Z1.

A preferred embodiment of the rolling mill of the present invention is described above with reference to the attached drawings. However, the present invention is not restricted to the above embodiment. The shapes and combinations of the components in the embodiment are shown as examples, and can be modified in various ways based on design requirements without departing from the scope of the present invention.

For example, the temperature adjusted oil Z2 is heated by the heaters 72 and the heated temperature adjusted oil Z2 is applied to the work roll 12 to control the crown rate of the work roll 12 in the above embodiment.

However, the present invention is not restricted thereto. For example, a cooling unit can be provided and the temperature adjusted oil Z2 cooled by the cooling unit can be applied to the work roll 12 to control the crown rate of the work roll 12 in place of the beaters 72.

The guide 2 for work rolls 11 and 12 is provided only at the entry point of the plate material X in the above embodiment. However, the present invention is not restricted thereto. The guide 2 for the work rolls 11 and 12 can be provided both at the entry point of the plate material X and at the exit point of the sheet Y.

In such a case, the temperature adjusted oil passage can be formed within only one of the guides or within both guides.

The rolling oil passage 3 and temperature adjusted oil passage 4 are provided one above the other in the above embodiment. However, the present invention is not restricted thereto.

For example, multiple rolling oil passages and multiple temperature adjusted oil passages can alternately be arranged in the crosswise direction of the work rolls.

A rolling mill in which the back up rolls 13, 14, 15, and 16 are provided in contact with the work rolls 11 and 12 is described in the above embodiment. However, the present invention is not restricted thereto. The present invention can be applied to any rolling mill in which the rolling oil is supplied between the work rolls through a passage formed within the guide.

The temperature adjusted oil passage 4 is divided into ten passages 43*a* to 43*j* in the above embodiment. However, the present invention is not restricted thereto. For example, the temperature adjusted oil passage 4 can be divided into an increased/decreased number of passages depending on the width of the work rolls 11 and 12.

What is claimed is:

1. A rolling mill comprising:

a pair of work rolls for rolling a plate material in a thickness direction;

a guide for guiding a leading end of the plate material between the work rolls, the guide comprising a rolling oil passage formed within the guide and a plurality of temperature adjusted oil passages formed within the guide, each of the plurality of temperature adjusted oil passages being distinct from the rolling oil passage;

a rolling oil supply member for supplying a rolling oil between said the work rolls through the rolling oil passage;

a plurality of temperature adjusted oil ducts, each of the temperature adjusted oil ducts being connected to one of the temperature adjusted oil passages and each of the temperature adjusted oil ducts further comprising a valve independently adjusted an oil flow rate of a temperature adjusted oil and a heater independently adjusted an oil temperature of the temperature adjusted oil; and a temperature adjusted oil supply member for supplying the temperature adjusted oil having a different temperature from the rolling oil to the work rolls through the plurality of temperature adjusted oil ducts and the plurality of temperature adjusted oil passages so as to control a crown rate of the work rolls.

2. A rolling mill according to claim 1 wherein the temperature adjusted oil supply member comprises:

a profile data acquisition member for acquiring a data indicating a profile of the plate material rolled by the work rolls; and a control member for the controlling the valve and the heater of the each temperature adjusted oil ducts to control the oil temperature and the oil flow rate of the temperature adjusted oil based on the data indicating the profile of the plate material.

3. A rolling mill according to claim 1 wherein a heat insulator is provided between the rolling oil passage and the temperature adjusted oil passages.

4. A rolling mill according to claim 1 wherein the guide comprises an upper portion located above the plate material and a lower portion located below the plate material, and wherein the temperature adjusted oil passages are formed only in the lower portion of the guide.

5. A rolling mill according to claim 4 wherein the rolling oil passage is provided in the upper portion.

6. A rolling mill according to claim 1 further comprising rolls which are provided in contact with said work rolls.

7. A rolling mill according to claim 1 wherein the upper portion of the guide is shorter than the lower portion of the guide.

* * * * *